US009301351B2

(12) United States Patent
Hsiung et al.

(10) Patent No.: US 9,301,351 B2
(45) Date of Patent: Mar. 29, 2016

(54) DRIVING CIRCUIT AND DRIVING METHOD FOR LIGHT-EMITTING DIODE

(71) Applicant: GETAC TECHNOLOGY CORPORATION, Hsinchu County (TW)

(72) Inventors: Ta-Sung Hsiung, Taoyuan County (TW); Jui-Lin Hsu, Keelung (TW)

(73) Assignee: Getac Technology Corporation, Hsinchu County (TW)

( * ) Notice: Subject to any disclaimer, the term of this patent is extended or adjusted under 35 U.S.C. 154(b) by 357 days.

(21) Appl. No.: 14/137,652

(22) Filed: Dec. 20, 2013

(65) Prior Publication Data

US 2015/0061529 A1 Mar. 5, 2015

Related U.S. Application Data

(60) Provisional application No. 61/871,982, filed on Aug. 30, 2013.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0815* (2013.01); *H05B 33/086* (2013.01)

(58) Field of Classification Search

USPC ..... 315/291, 294, 295

See application file for complete search history.

(56) References Cited

U.S. PATENT DOCUMENTS

| | | | | |
|---|---|---|---|---|
| 2011/0156603 | A1* | 6/2011 | Ko | H05B 33/0818 315/185 R |
| 2013/0026924 | A1* | 1/2013 | Jong | H05B 33/0818 315/113 |
| 2015/0245433 | A1* | 8/2015 | McCune, Jr. | H05B 33/0845 315/294 |
| 2015/0296581 | A1* | 10/2015 | Tsai | H05B 33/0845 315/291 |
| 2015/0312980 | A1* | 10/2015 | Hu | H05B 33/0815 315/186 |
| 2015/0334798 | A1* | 11/2015 | Jung | H05B 33/0851 315/186 |
| 2015/0351193 | A1* | 12/2015 | Chao | H05B 33/0887 315/122 |
| 2015/0373807 | A1* | 12/2015 | Kao | H05B 33/0809 315/185 R |
| 2015/0382421 | A1* | 12/2015 | Chowdhury | H05B 33/0809 315/201 |
| 2016/0007428 | A1* | 1/2016 | Nian | H05B 7/0263 315/193 |

* cited by examiner

*Primary Examiner* — Adam Houston

(57) ABSTRACT

The present invention relates to a driving circuit and a driving method for LED. The driving circuit for LED comprises an inductor used for producing an output current, a power switch coupled to the inductor and used for controlling the inductor to transmit the output current to a plurality of LEDs and drive the plurality of LEDs, an adjusting circuit receiving a PWM signal related to the output current, and a driving unit producing an adjusting impedance value according to the PWM signal. The driving unit generates a switching signal according to the adjusting impedance value. The switching signal switches the power switch and enables the inductor to produce the output current. The driving unit adjusts the frequency of the switching signal according to the adjusting impedance value.

10 Claims, 6 Drawing Sheets

DRIVING CIRCUIT AND DRIVING METHOD FOR LIGHT-EMITTING DIODE

FIELD OF THE INVENTION

The present invention relates generally to a driving circuit and a driving method, and particularly to a driving circuit and a driving method for light-emitting diode (LED).

BACKGROUND OF THE INVENTION

LEDs are semiconductor electronic devices capable of emitting light and composed by P- and N-type semiconductor materials. They can radiate light in the ultraviolet, visible, and infrared regions. Thanks to their advantages of saving power, long lifetime, and high brightness, in the recent trend of environmental protection, saving energy, and reducing carbon emission, the applications of LEDs, for example, traffic lights, streetlamps, flashlights, display devices, or illumination devices, become extensive increasingly.

Currently, most LED display devices, such as notebook computers or LCD panels, adopts LED driving circuits to output pulse width modulation (PWM) signals as the dimming signals of LEDs for adjusting the duty cycle of switching signals. Thereby, LEDs are switched on and off and thus achieving the purpose of adjusting the brightness of LEDs.

Nonetheless, in a general LED driving circuit, the inductance of the internal inductor in the driving circuit has to match the duty cycles of the switching signal and the output current to the LED. For example, if the input power supply, the output voltage, and the frequency of the switching signal are maintained, when the output current is lowered by increasing the duty cycle of the switching signal for tuning light, the inductance of the inductor should be larger for avoiding spikes in the switching signal and the output current.

Please refer to FIGS. 1A and 1B. FIG. 1A shows waveforms of the switching signal with 100% duty cycle of the driving circuit for LED according to the prior art; FIG. 1B shows waveforms of the switching signal with 20% duty cycle of the driving circuit for LED according to the prior art. As shown in the figures, when the duty cycle of the switching signal $V_{GP}$ is 100%, the output current $I_{OP}$ is normal. When the duty cycle of the switching signal $V_{GP}$ is 20%, because the inductance of the inductor inside the driving circuit is insufficient, spikes occur in both the switching signal $V_{GP}$ and the output current $I_{OP}$. Thereby, for tuning LED light, a plurality of series inductors are usually disposed for meeting the requirement of larger inductance. Nonetheless, the plurality of series inductors will result in the problems of increased circuit area and cost.

Accordingly, the present invention provides a driving circuit for LED and a driving method thereof, which adjusts the switching frequency for supplying the required output current. Hence, the problems described above can be solved.

SUMMARY

An objective of the present invention is to provide a driving circuit for LED and a driving method thereof. An adjusting circuit produces an adjusting impedance value according to the duty cycle of a PWM signal. A driving unit adjusts the frequency of a switching signal according to the adjusting impedance value for matching the output current to the LED. It is not required to change the inductance of the inductor inside the driving circuit or dispose other series inductors. Thereby, the circuit area and cost can be reduced.

For achieving the objective and effect described above, the present invention discloses a driving circuit for LED, which comprises an inductor, a power switch, an adjusting circuit, and a driving unit. The inductor is used for producing an output current. The power switch is coupled to the inductor and used for controlling the inductor to transmit the output current to a plurality of LEDs and drive the plurality of LEDs. The adjusting circuit receives a PWM signal related to the output current. Then the adjusting circuit produces an adjusting impedance value according to the PWM signal. The driving unit generates a switching signal according to the adjusting impedance value. The switching signal switches the power switch and enables the inductor to produce the output current. The driving unit adjusts the frequency of the switching signal according to the adjusting impedance value. The frequency of the switching signal becomes higher as the output current becomes smaller.

The present invention further discloses a driving method for LED, which comprises the steps of: producing an output current by using an inductor; controlling the inductor to transmit the output current to a plurality of LEDs by using a power switch and drive the plurality of LEDs; transmitting a PWM signal related to the output current to an adjusting circuit and the adjusting circuit producing an adjusting impedance value according to the PWM signal; and generating a switching signal according to the adjusting impedance value, the switching signal switching the power switch and enabling the inductor to produce the output current, and adjusting the frequency of the switching signal according to the adjusting impedance value.

DETAILED DESCRIPTION

In order to make the structure and characteristics as well as the effectiveness of the present invention to be further understood and recognized, the detailed description of the present invention is provided as follows along with embodiments and accompanying figures.

Figure 1A:
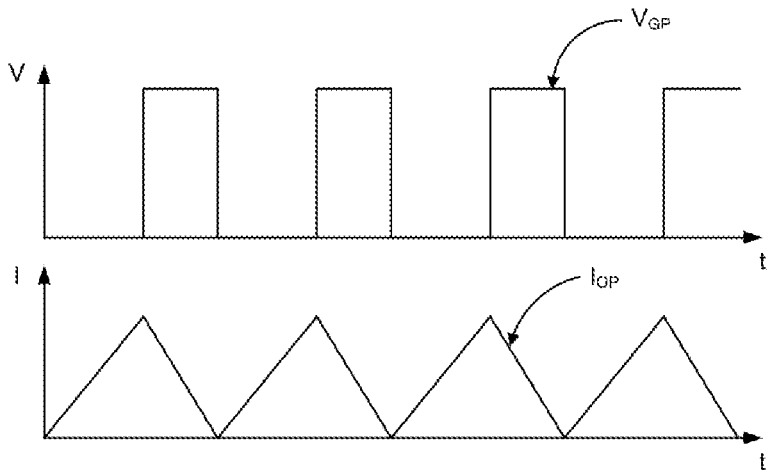
Figure 1A(Prior art)
FIG. 1A shows waveforms of the switching signal with 100% duty cycle of the driving circuit for LED according to the prior art.
Figure 1B:
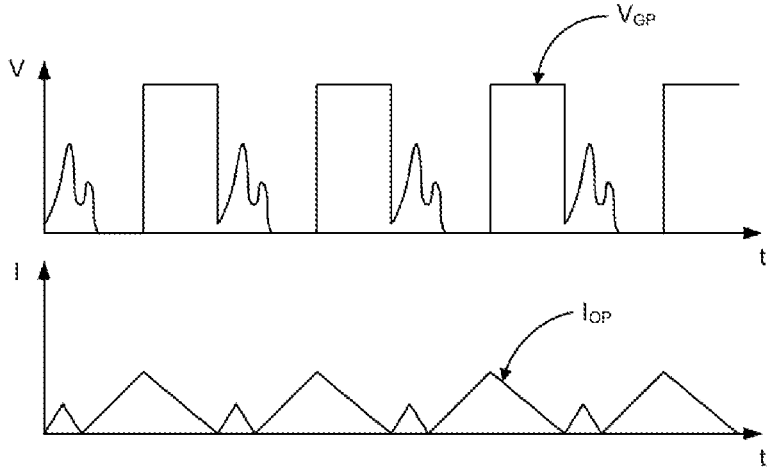
Figure 1B(Prior art)
FIG. 1B shows waveforms of the switching signal with 20% duty cycle of the driving circuit for LED according to the prior art.
Figure 2:
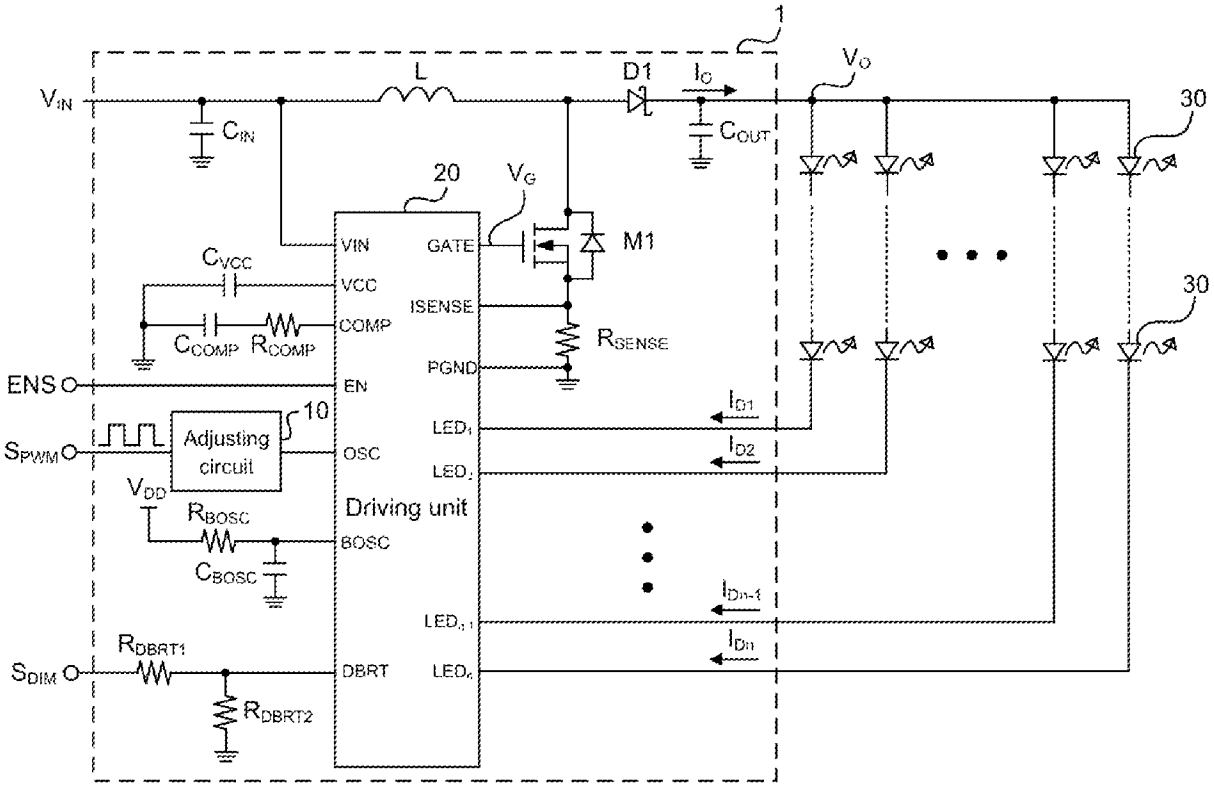
FIG. 2 shows a circuit diagram of the driving circuit for LED according to a preferred embodiment of the present invention.
Figure 4:
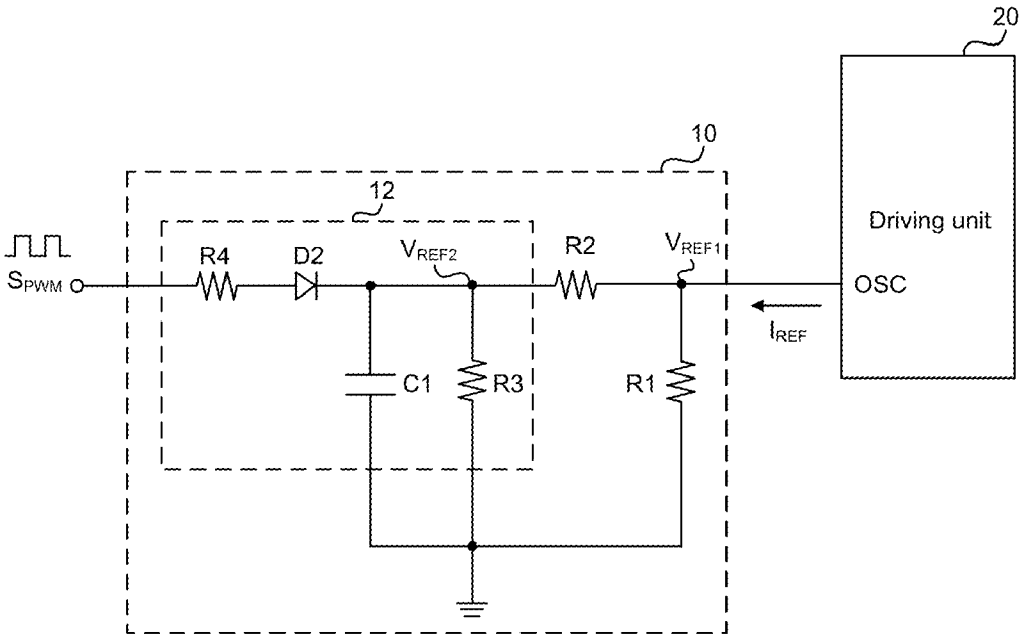
FIG. 4 shows a circuit diagram of the adjusting circuit according to a preferred embodiment of the present invention.

Please refer to FIG. 2, which shows a circuit diagram of the driving circuit for LED according to a preferred embodiment of the present invention. As shown in the figure, the driving circuit 1 for LED according to the present invention comprises an inductor L, a power switch M1, an adjusting circuit 10, and a driving unit 20. The inductor L receives an input power supply $V_{IN}$ for charging, discharging, and producing an output current $I_O$. The power switch M1 is coupled to the inductor L and switches according to a switching signal $V_G$. The adjusting circuit 10 receives a PWM signal $S_{PWM}$ and produces an adjusting impedance value according to the duty cycle of the PWM signal $S_{PWM}$, as shown in FIG. 4. The details of the adjusting impedance value will be explained later. A frequency setting pin OSC of the driving unit 20 is coupled to the adjusting circuit 10 and generating the switching signal $V_G$ according to the adjusting impedance value. The switching signal $V_G$ is used for switching the power switch M1. Specifically, when the power switch M1 is turned on, the input power supply $V_{IN}$ charges the inductor L. When the power switch M1 is turned off, the inductor L outputs the output current $I_O$ to a plurality of LEDs 30 for forming a plurality of driving currents $I_{D1}$-$I_{Dn}$, flowing through the plurality of LEDs 30.

The inductance of the inductor L can be obtained from the following Equation (1). $V_O$ is the output voltage output to the plurality of LEDs 30; Fsw is the frequency of the switching signal $V_G$. For conventional techniques, when the input power supply $V_{IN}$, the output voltage $V_O$, and the frequency Fsw of the switching signal $V_G$ are maintained, if the output current $I_O$ is adjusted smaller for tuning light, the inductance of the inductor L will definitely increase. In other words, an inductor L with a larger inductance is required for tuning the light of the LEDs 30. The solution according to the prior art is to dispose a plurality of series inductors for attaining a larger inductance.

However, the present invention is characterized technically in avoiding disposing a plurality of series inductors, and thus preventing increases in circuit area and cost, by adjusting the frequency Fsw of the switching signal. Specifically, according to the present invention, under the conditions of not increasing inductors and maintaining the inductance, light tuning is accomplished by switching the frequency Fsw to achieve adjusting the amplitude of the output current $I_O$.

$$L = \frac{V_{IN} * (V_O - V_{IN})}{V_O * F_{SW} * I_O} \quad (1)$$

In addition, the driving circuit 1 can further comprises an input capacitor $C_{IN}$, a diode D1, and an output capacitor $C_{OUT}$. The input capacitor $C_{IN}$ receives the input power supply $V_{IN}$, and is used for stabilizing the voltage of the input power supply $V_{IN}$ and outputting the input power supply $V_{IN}$. The diode D1 is coupled to the inductor L for maintaining unidirectional conduction of current. The output capacitor $C_{OUT}$ receives the output current $I_O$, and is used for outputting the output current $I_O$ to the plurality of LEDs 30.

Besides, the driving unit 20 further comprises an input power pin VIN, a supply voltage pin VCC, a compensation pin COMP, a light-tuning-frequency setting pin BOSC, an enable control pin EN, a bright-controlling pin DBRT, a gate control pin GATE, a current sensing pin ISENSE, and a ground pin PGND.

The input power pin VIN receives the input power supply $V_{IN}$. The power switch M1 has a first terminal, a second terminal, and a control terminal. The first terminal of the power switch M1 is coupled to the current sensing pin ISENSE. The control terminal of the power switch M1 is coupled to the gate control pin GATE and controlled by the switching signal $V_G$ for determining if the output current $I_O$ is output by the inductor L. A sensing resistor $R_{SENSE}$ is coupled between the current sensing pin ISENSE and the ground pin PGND. The ground pin PGND is further coupled to a ground. When the power switch M1 is turned on, the sensing resistor $R_{SENSE}$ converts the received current to a current sensing signal and outputs the current sensing signal to the current sensing pin ISENSE. When the power switch M1 is turned off, the inductor L outputs the output current $I_O$ to the plurality of LEDs 30.

A capacitor $C_{VCC}$ is coupled between the supply voltage pin VCC and the ground. A capacitor $C_{COMP}$ is connected in series with a resistor $R_{COMP}$ and coupled between the compensation pin COMP and the ground. A resistor $R_{BOSC}$ receives a supply voltage $V_{DD}$ and is coupled to the light-tuning-frequency setting pin BOSC. A capacitor $C_{BOSC}$ is coupled between the light-tuning-frequency setting pin BOSC and the ground. The enable control pin EN receives an enable signal ENS. A resistor $R_{DBRT1}$ is coupled to the bright-controlling pin DBRT and receives a dimming signal $S_{DIM}$. A resistor $R_{DBRT2}$ is coupled between the bright-controlling pin DBRT and the ground. The dimming signal $S_{DIM}$ is used for adjusting the brightness of the plurality of LEDs 30.

Figure 3:
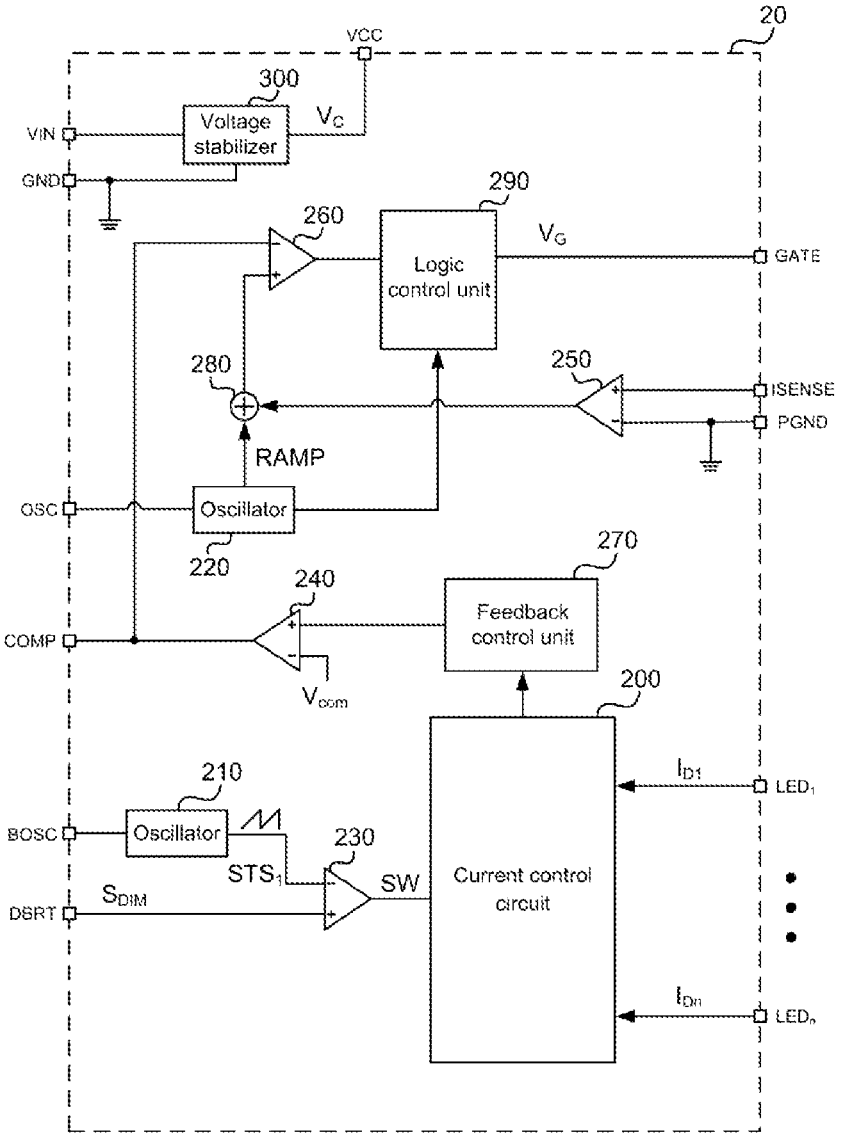
FIG. 3 shows a circuit diagram of the driving unit according to a preferred embodiment of the present invention.

Please refer to FIG. 3, which shows a circuit diagram of the driving unit according to a preferred embodiment of the present invention. As shown in the figure, the driving unit 20 comprises a current control circuit 200, oscillators 210, 220, comparators 230, 240, 250, 260, a feedback control unit 270, an operational unit 280, a logic control unit 290, and a voltage stabilizer 300. The current control circuit 200 is coupled to the plurality of LEDs 30 via the plurality of LED pins $LED_1$-$LED_n$. The current control circuit 200 is used for producing the plurality of driving currents $I_{D1}$-$I_{Dn}$.

The oscillator 210 is coupled between the light-tuning-frequency setting pin BOSC and a negative input of the comparator 230 and outputs a saw-toothed signal $STS_1$ to the negative input of the comparator 230. A positive input of the comparator 230 is coupled to the bright-controlling pin DBRT for receiving the dimming signal $S_{DIM}$. The comparator 230 compares the dimming signal $S_{DIM}$ and the saw-toothed signal $STS_1$ for outputting a switching signal SW and enabling the current control circuit 200 to produce the plurality of driving currents $I_{D1}$-$I_{Dn}$.

A positive input of the comparator 250 is coupled to the current sensing pin ISENSE. A negative input of the comparator is coupled to the ground pin PGND and the ground, and outputs after comparing the current sensing signal and the voltage level of the ground. The feedback control unit 270 is used for detecting the signal output by the current control circuit 200 and outputting a feedback signal to a positive input of the comparator 240. A negative input of the comparator 240 receives a comparing voltage $V_{com}$ and outputs to the compensation pin COMP after comparing the feedback signal and the comparing voltage $V_{com}$. The oscillator 220 is coupled among the frequency setting pin OSC, the operational unit 280, and the logic control unit 290 and outputs an oscillation signal RAMP to the operational unit 280 and the logic control unit 290. The operational unit 290 outputs to a positive input of the comparator 260 after operating the oscillation signal RAMP and the output of the comparator 250. A negative input of the comparator 260 receives the output of the comparator 240 and uses it as a threshold value. The comparator 260 compares the threshold value and the operational result output by the operational unit 280 and outputs a comparison signal. Then the logic control unit 290 generates the switching signal $V_G$ according to the comparison signal and the oscillation signal RAMP.

The voltage stabilizer 300 is coupled to the input power pin VIN, the supply voltage pin VCC, and the ground, and produces a supply voltage $V_C$ at the supply voltage pin VCC according to the input power supply $V_{IN}$ received by the input power pin VIN.

Please refer to FIG. 4, which shows a circuit diagram of the adjusting circuit according to a preferred embodiment of the present invention. As shown in the figure, the adjusting circuit 10 comprises a plurality of resistors R1, R2, and a signal generating unit 12. The resistor R1 has a first terminal and a second terminal. The first terminal of the resistor R1 is coupled to the frequency setting pin OSC of the driving unit 20 for receiving a reference voltage $V_{REF1}$ output by the driving unit 20. The second terminal of the resistor R1 is coupled to the ground. The resistor R2 has a first terminal and a second terminal. The first terminal of the resistor R2 is coupled to the first terminal of the resistor R1 and the frequency setting pin OSC of the driving unit 20 for receiving the reference voltage $V_{REF1}$. The second terminal of the resistor R2 receives a reference voltage $V_{REF2}$. The signal generating unit 12 receives the PWM signal $S_{PWM}$ and produces the reference voltage $V_{REF2}$ according to the PWM signal $S_{PWM}$.

The signal generating unit 12 comprises a plurality of resistors R3, R4 and a diode D2. The resistor R3 has a first terminal and a second terminal. The first terminal of the resistor R3 is coupled to a first terminal of the diode D2; the second terminal of the resistor R3 is coupled to the ground. The resistor R4 has a first terminal and a second terminal. The first terminal of the resistor R4 is coupled to a second terminal of the diode D2; the second terminal of the resistor R4 receives the PWM signal $S_{PWM}$. The resistors R3, R4 divide the voltage of the PWM signal $S_{PWM}$ and produce the reference voltage $V_{REF2}$. Here, the diode D2 is used for maintaining unidirectional conduction of the current of the PWM signal $S_{PWM}$. Nonetheless, in this embodiment of the present invention, the signal generating unit 12 may not require the diode D2. Since the diode D2 added is a preferred embodiment of the present invention, the signal generating unit 12 having the diode D2 is used as an example in the following description and calculations. A person having ordinary skill in the art should understand that the embodiment of a signal generating unit 12 without the diode D2 is the same in concept as the embodiment of one with a signal generating unit 12.

The duty cycle of the PWM signal $S_{PWM}$ determines the voltage level of the reference voltage $V_{REF2}$. When the PWM signal $S_{PWM}$ is high, the voltage level of the reference voltage $V_{REF2}$ is produced by dividing the voltage of the PWM signal $S_{PWM}$ by the resistors R3, R4. When the PWM signal $S_{PWM}$ is low, because the PWM signal $S_{PWM}$ is 0V, the voltage level of the reference voltage $V_{REF2}$ is lowered to 0V accordingly. In addition, the following Equation (2) is given, where $V_{PWM}$ is the voltage level of the PWM signal $S_{PWM}$ at high level; D is the percentage of the PWM signal $S_{PWM}$ at high level in a period; namely, D is the percentage of the duty cycle.

$$V_{REF2} = \frac{V_{PWM} * R3}{R3 + R4} * D \tag{2}$$

In order to let a person having ordinary skill in the art more understand the technical characteristics of the present invention, an embodiment is described for example. Assume the resistor R1 is 100 KΩ, the resistor R2 is 200 KΩ, the resistor R3 is 246K, the resistor R4 is 754 KΩ, and the reference voltage $V_{REF1}$ is 1.23V, and $V_{PWM}$ is 5V, and the duty cycle is 0, according to Equation (2), the voltage level of the reference voltage $V_{REF2}$ is 0V. Thereby, the second terminal of the resistor R2 is equivalent to connecting to the ground directly. The total impedance (the adjusting impedance value) viewing from the driving unit 20 to the adjusting circuit 10 is the resistance of the resistors R1, R2 connected in parallel, namely, 66.67 KΩ. On the other hand, when the duty cycle is 1, according to Equation (2), the voltage level of the reference voltage $V_{REF2}$ is 1.23V, which is equal to the voltage level of the reference voltage $V_{REF1}$. Hence, there will be no current flowing through the resistor R2 and the resistor R2. Since the resistor R2 is equivalent to an open circuit, the total impedance (the adjusting impedance value) viewing from the driving unit 20 to the adjusting circuit 10 is the resistance of the resistors R1, namely, 100 KΩ. Apparently, it is known that the adjusting impedance value of the adjusting circuit 10 is proportional to the duty cycle of the PWM signal $S_{PWM}$.

According to the above description, the present embodiment determines the voltage level of the reference voltage $V_{REF2}$ according to the PWM signal $S_{PWM}$ for producing the adjusting impedance value. As the duty cycle of the PWM signal $S_{PWM}$ becomes larger, the adjusting impedance value becomes larger; as the duty cycle of the PWM signal $S_{PWM}$ becomes smaller, the adjusting impedance value becomes smaller. The driving unit 20 adjusts the frequency Fsw of the switching signal $V_G$ according to the adjusting impedance value. When the adjusting impedance value is larger, the frequency Fsw of the switching signal $V_G$ is adjusted smaller; when the adjusting impedance value is smaller, the frequency Fsw of the switching signal $V_G$ is adjusted larger.

Furthermore, the duty cycle of the PWM signal $S_{PWM}$ is related to the duty cycle of the switching signal $V_G$. The duty cycle of the PWM signal $S_{PWM}$ and the duty cycle of the switching signal $V_G$ are determined by the magnitude of the output current $I_O$. Thereby, when the magnitude of the output current $I_O$ is increased by tuning light, the duty cycles of the PWM signal $S_{PWM}$ and the switching signal $V_G$ are both increased, such that the adjusting impedance value of the adjusting circuit 10 increases with them. Then the oscillation signal RAMP output by the oscillator 220 as shown in FIG. 3 is adjusted smaller according to the adjusting impedance value and thus lowering the frequency Fsw of the switching signal $V_G$, and vice versa. Thereby, the inductance of the inductor L in Equation (1) is unchanged.

Moreover, because the reference voltage $V_{REF1}$ is provided by the driving unit 20 with a fixed voltage, the reference current $I_{REF}$ flowing from the driving unit 20 to the adjusting circuit 10 will be influenced by the adjusting impedance value. Besides, the magnitude of the reference current $I_{REF}$ is inversely proportional to the adjusting impedance value of the adjusting circuit 10.

In addition, the signal generating unit 12 can further comprise a voltage stabilizing capacitor C1. The first terminal of the voltage stabilizing capacitor C1 is coupled to the first terminal of the resistor R3; the second terminal of the voltage stabilizing capacitor C1 is coupled to the ground; the voltage stabilizing capacitor C1 is used for stabilizing the voltage level of the reference voltage $V_{REF2}$. As for the diode D2, the first terminal thereof is coupled to the first terminal of the resistor R3; the second terminal of the diode D2 is coupled to the first terminal of the resistor R4. The diode D2 is coupled between the first terminals of the resistor R3 and the first voltage stabilizing capacitor C1.

Figure 5A:
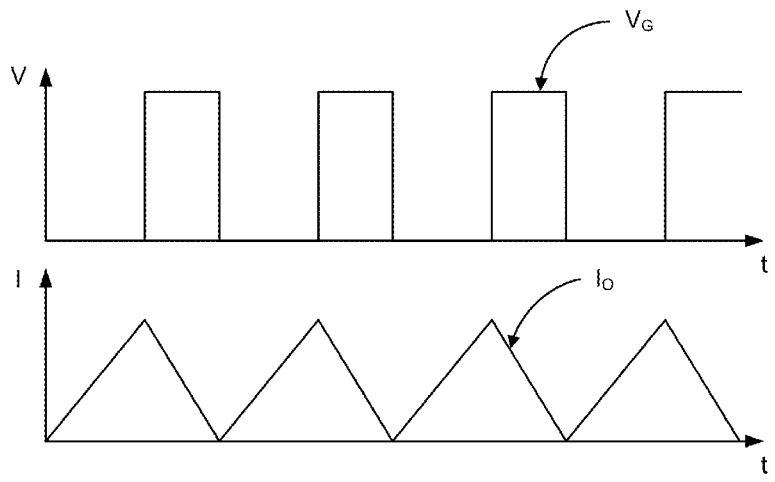
FIG. 5A shows waveforms of the switching signal with 100% duty cycle according to the present invention.
Figure 5B:
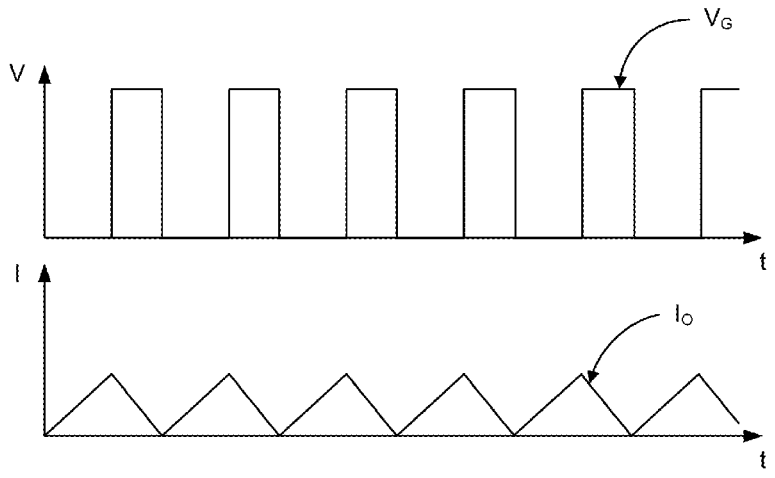
FIG. 5B shows waveforms of the switching signal with 20% duty cycle according to the present invention.

Please refer to FIGS. 5A and 5B. FIG. 5A shows waveforms of the switching signal with 100% duty cycle according to the present invention; FIG. 5B shows waveforms of the switching signal with 20% duty cycle according to the present invention. Because the frequency and the duty cycle of the oscillation signal RAMP correspond to the frequency Fsw and the duty cycle of the switching signal $V_G$, in FIGS. 5A and 5B, the relation between the switching signal $V_G$ and the output current $I_O$ is used for expressing the relation between the oscillation signal RAMP and the output current $I_O$.

As shown in the figures, as the duty cycle of the PWM signal $S_{PWM}$ is adjusted from 100% down to 20%, namely, the duty cycles of the oscillation signal RAMP and the switching signal $V_G$ are adjusted down to 20% owing to the output current $I_O$ (i.e. adjusted from FIG. 5A to FIG. 5B), and because the frequencies of the oscillation signal RAMP and the switching signal $V_G$ will be adjusted higher by the adjusting circuit 10 and the oscillator 220 (as will be described in FIG. 6), an inductor L having a large inductance is not required and meets Equation (1).

Figure 6:
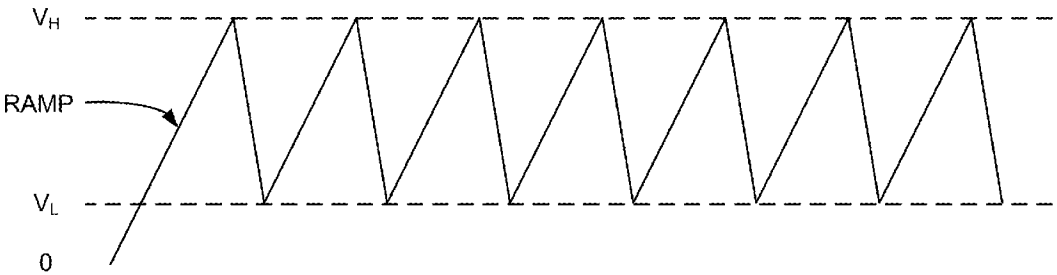
FIG. 6 shows a waveform of the oscillating signal according to a preferred embodiment of the present invention.

Please refer to FIG. 6, which shows a waveform of the oscillating signal according to a preferred embodiment of the present invention. As shown in the figure, the voltage level of the oscillation signal RAMP will be limited between a high reference value $V_H$ and a low reference value $V_L$ set in the oscillator 220. In addition, because the oscillation signal RAMP is generated by charging according to a charging current $I_C$ in the oscillator 220, the larger the magnitude of the charging current $I_C$, the faster the oscillation signal RAMP will be raised to the high reference value $V_H$. In other words, the frequency of the oscillation signal RAMP will be faster. Hence, the magnitude of the charging current $I_C$ is determined by the magnitude of the reference current $I_{REF}$.

Therefore, when the duty cycle of the PWM signal $S_{PWM}$ increases, the adjusting impedance value of the adjusting circuit 10 is adjusted larger, which makes the magnitude of the reference current $I_{REF}$ following from the oscillator 220 to the adjusting circuit 10 via the frequency setting pin OSC become smaller. Consequently, the magnitude of the charging current $I_C$ becomes smaller accordingly, which slows down the charging rate of charging current $I_C$ to the inside of the oscillator 220 and lowers the frequency of the oscillation signal RAMP. On the other hand, when the duty cycle of the PWM signal $S_{PWM}$ decreases, the adjusting impedance value of the adjusting circuit 10 is adjusted smaller, which makes the magnitude of the reference current $I_{REF}$ become larger. Consequently, the magnitude of the charging current $I_C$ becomes larger accordingly, which increases the charging rate of charging current $I_C$ inside the oscillator 220 and raises the frequency of the oscillation signal RAMP.

To sum up, the driving circuit for LED according to the present invention comprises an adjusting circuit and a driving unit. The adjusting circuit produces an adjusting impedance value according to the duty cycle of the PWM signal. The driving unit adjusts the frequency of the switching signal according to the adjusting impedance value. Thereby, the frequency of the switching signal can coordinate with the output current to the LEDs. It is not necessary to change the inductance of the inductor in the driving circuit or dispose other series inductors. Accordingly, the circuit area and cost can be reduced.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A driving circuit for light-emitting diode, comprising:

an inductor, used for producing an output current;

a power switch, coupled to said inductor, and used for controlling said inductor to transmit said output current to a plurality of light-emitting diodes and drive said plurality of light-emitting diodes;

an adjusting circuit, receiving a pulse width modulation signal related to said output current, and producing an adjusting impedance value according to said pulse width modulation signal; and a driving unit, generating a switching signal according to said adjusting impedance value, switching said power switch and enabling said inductor to produce said output current, and adjusting the frequency of said switching signal according to said adjusting impedance value;

where the frequency of said switching signal becomes higher as said output current becomes smaller.

2. The driving circuit of claim 1, wherein said adjusting circuit comprises:

a first resistor, having a first terminal and a second terminal, said first terminal of said first resistor coupled to a frequency setting pin of said driving unit for receiving a first reference voltage, and said second terminal of said first resistor coupled to a ground;

a second resistor, having a first terminal and a second terminal, said first terminal of said second resistor coupled to said first terminal of said first resistor and said frequency setting pin for receiving said first reference voltage, and said second terminal of said second resistor receiving a second reference voltage; and a signal generating unit, receiving said pulse width modulation signal, and producing said second reference voltage according to said pulse width modulation signal;

where said first reference voltage and said second reference voltage determine the total impedance value of said first resistor and said second resistor and produce said adjusting impedance value.

3. The driving circuit of claim 2, wherein when said first reference voltage is equal to said second reference voltage, said adjusting impedance value is equal to the impedance value of said first resistor; and when said second reference voltage is zero, said adjusting impedance value is equal to the total impedance value of said first resistor in parallel with said second resistor.

4. The driving circuit of claim 2, wherein said signal generating unit comprises:

a third resistor, having a first terminal and a second terminal, said first terminal of said third resistor coupled to said second terminal of said second resistor, and said second terminal of said third resistor coupled to said ground; and a fourth resistor, having a first terminal and a second terminal, said first terminal of said fourth resistor coupled to said first terminal of said third resistor and said second terminal of said second resistor, and said second terminal of said fourth resistor receiving said pulse width modulation signal;

where said third resistor and said fourth resistor divide the voltage of said pulse width modulation signal and produce said second reference voltage.

5. The driving circuit of claim 4, wherein said signal generating unit further comprises a voltage stabilizing capacitor, having a first terminal and a second terminal, said first terminal of said voltage stabilizing capacitor coupled to said first terminal of said third resistor, and said second terminal of said voltage stabilizing capacitor coupled to said ground for stabilizing said second reference voltage.

6. The driving circuit of claim 5, wherein said signal generating unit further comprises a diode, having a first terminal and a second terminal, said first terminal of said diode coupled to said first terminal of said third resistor, said second terminal of said diode coupled to said first terminal of said fourth resistor, and said diode coupled between said first terminal of said fourth resistor and said first terminal of said voltage stabilizing capacitor.

7. The driving circuit of claim 1, wherein said driving unit comprises:

an oscillator, coupled to a frequency setting pin of said driving unit, and generating an oscillation signal according to said adjusting impedance value;

a comparator, coupled to said oscillator, and generating a comparison signal according to said oscillation signal and a threshold value; and a logic control unit, coupled to said comparator, and generating said switching signal according to said comparison signal and switching said power switch.

8. A driving method for light-emitting diode, comprising the steps of:

producing an output current by using an inductor;

controlling said inductor to transmit said output current to a plurality of light-emitting diodes by using a power switch and drive said plurality of light-emitting diodes;

transmitting a pulse width modulation signal related to said output current to an adjusting circuit and said adjusting circuit producing an adjusting impedance value according to said pulse width modulation signal; and generating a switching signal according to said adjusting impedance value, said switching signal switching said power switch and enabling said inductor to produce said output current, and adjusting the frequency of said switching signal according to said adjusting impedance value;

where the frequency of said switching signal becomes higher as said output current becomes smaller.

9. The driving method of claim 8, wherein said step of producing an adjusting impedance value according to said pulse width modulation signal comprises the steps of:

providing a first reference voltage to a first terminal of a first resistor and a first terminal of a second resistor;

producing a second reference voltage according to said pulse width modulation signal, and providing said second reference voltage to said second resistor; and said first reference voltage and said second reference voltage determining the total impedance value of said first resistor and said second resistor and producing said adjusting impedance value.

10. The driving method of claim 9, wherein when said first reference voltage is equal to said second reference voltage, said adjusting impedance value is equal to the impedance value of said first resistor; and when said second reference voltage is zero, said adjusting impedance value is equal to the total impedance value of said first resistor in parallel with said second resistor.

* * * * *